US011325732B2

(12) United States Patent
Scrivani

(10) Patent No.: US 11,325,732 B2
(45) Date of Patent: May 10, 2022

(54) PACKAGING MACHINE AND METHOD FOR MAKING CAPSULES

(71) Applicant: AZIONARIA COSTRUZIONI MACCHINE AUTOMATICHE A.C.M.A. S.p.A., Bologna (IT)

(72) Inventor: Massimo Scrivani, Casteggio (IT)

(73) Assignee: AZIONARIA COSTRUZIONI MACCHINE AUTOMATICHE A.C.M.A. S.P.A., Bologna (IT)

( * ) Notice: Subject to any disclaimer, the term of this patent is extended or adjusted under 35 U.S.C. 154(b) by 328 days.

(21) Appl. No.: 16/423,911

(22) Filed: May 28, 2019

(65) Prior Publication Data

US 2019/0276172 A1 Sep. 12, 2019

Related U.S. Application Data

(62) Division of application No. 14/904,913, filed as application No. PCT/IB2014/063344 on Jul. 23, 2014, now Pat. No. 10,358,240.

(30) Foreign Application Priority Data

Jul. 23, 2013 (IT) ..... BO2013A000390

(51) Int. Cl.
*B65B 29/02* (2006.01)
*B65B 61/00* (2006.01)
*B65B 7/01* (2006.01)

(52) U.S. Cl.
CPC ..... *B65B 29/02* (2013.01); *B65B 7/01* (2013.01); *B65B 29/022* (2017.08); *B65B 61/005* (2013.01)

(58) Field of Classification Search
CPC ..... B65B 29/02; B65B 29/022; B65B 29/06; B65B 1/02; B65B 59/005; B65B 61/005;
(Continued)

(56) References Cited

U.S. PATENT DOCUMENTS 4,625,498 A * 12/1986 Parsons ..... B65B 7/164 156/261
4,682,463 A * 7/1987 Foldesi ..... B65B 7/2878 53/298
(Continued)

FOREIGN PATENT DOCUMENTS

CN 102574591 7/2012
DE 102007053034 A1 5/2009
(Continued)

OTHER PUBLICATIONS

International Search Report and Written Opinion dated Nov. 21, 2014 from counterpart PCT App No. PCT/IB2014/063344.
(Continued)

*Primary Examiner* — Dariush Seif
(74) *Attorney, Agent, or Firm* — Shuttleworth & Ingersoll, PLC; Timothy J. Klima

(57) ABSTRACT

A packaging machine for making capsules of the type including a container having an inlet opening and a bottom and at least one substantially disc-shaped element associated with the container, including a movement system by which the containers are directed along a predetermined path in a feed direction; a movement means by which a continuous web for defining the disc-shaped elements is moved along a second predetermined path; a cutoff station where the disc-shaped elements are cut from the continuous web and which is positioned along the second predetermined path and an associating station where the disc-shaped elements are associated with the containers and which is positioned along the predetermined path; the associating station is distinct from the cutoff station and the machine includes a transfer system by which the disc-shaped elements are transferred from the cutoff station to the associating station.

20 Claims, 12 Drawing Sheets

(58) Field of Classification Search
CPC ..... B65B 61/20; B65B 7/164; B65B 7/2842; B65B 7/01; B65B 3/10; B65D 85/808; B65D 85/804; B65D 85/8043; A47J 31/08
USPC .... 53/410, 471, 420; 426/115, 86, 394, 425, 426/77; 493/56
See application file for complete search history.

(56) References Cited

U.S. PATENT DOCUMENTS 4,787,812 A * 11/1988 Gopfert ..... B66C 1/0212 414/737
5,108,768 A * 4/1992 So ..... B65D 85/8043 206/519
6,000,196 A * 12/1999 Boldrini ..... B65B 19/20 493/911
6,161,367 A * 12/2000 Walter ..... B65B 7/2807 53/133.3
6,439,631 B1 * 8/2002 Kress ..... B65G 47/918 294/65
6,440,256 B1 * 8/2002 Gordon ..... A47J 31/08 156/293
6,684,604 B2 * 2/2004 Luc ..... B65B 7/01 53/244
7,234,500 B2 * 6/2007 Gill ..... B26D 7/10 156/264
7,690,706 B2 * 4/2010 Wild ..... B65G 47/918 294/65
7,910,145 B2 * 3/2011 Reati ..... B65B 61/005 426/77
9,630,732 B2 * 4/2017 Hodler ..... B01D 27/005
9,688,465 B2 * 6/2017 Trombetta ..... B65B 61/20
9,708,086 B2 * 7/2017 Bianchi ..... B65B 61/20
2011/0023417 A1 * 2/2011 Finkowski ..... B65B 5/02 53/443
2012/0204516 A1 * 8/2012 Palumbo ..... B65B 41/06 53/403
2012/0233967 A1 * 9/2012 Bellante ..... B65B 5/105 53/443
2013/0212988 A1 * 8/2013 Schmeiser ..... B65B 7/164 53/558
2014/0230370 A1 * 8/2014 Bianchi ..... B65D 85/8043 53/410
2015/0013268 A1 * 1/2015 Rea ..... B65B 43/52 53/282
2015/0175347 A1 * 6/2015 Empl ..... A23F 5/262 426/433
2016/0068288 A1 * 3/2016 Palumbo ..... B29C 65/7841 53/511
2016/0144987 A1 * 5/2016 Scrivani ..... B65B 29/02 53/487

FOREIGN PATENT DOCUMENTS

FR 2827835 A1 1/2003
WO WO2013064988 A1 5/2013

OTHER PUBLICATIONS

Office Action issued by the Chinese Patent Office dated Nov. 16, 2016 for counterpart Chinese Application No. 201480041716.4.

* cited by examiner

PACKAGING MACHINE AND METHOD FOR MAKING CAPSULES

This application is a divisional of U.S. application Ser. No. 14/904,913 filed Jan. 13, 2016, which is a National Phase of International Application PCT/IB2014/063344 filed Jul. 23, 2014 which designated the U.S. and that International Application was published under PCT Article 21(2) in English. Both applications are incorporated by reference herein.

This application claims priority to Italian Patent Application No. BO2013A000390 filed Jul. 23, 2013, which application is incorporated by reference herein.

TECHNICAL FIELD

This invention relates to a packaging machine and a packaging method for making capsules containing aromatic substances for preparing infusions.

The reference capsules are single-use capsules basically comprising a container, for example cup-shaped, provided with a perforatable lid through which water can be fed, and a bottom through which is dispensed the beverage produced by effect of the infusion of the water with an aromatic substance present in the container.

BACKGROUND ART

Prior art packaging machines for making capsules comprise, very briefly, a conveying line for moving the containers along a predetermined path in a feed direction.

In a first station along the feed path is located a system, where provided, for feeding a continuous web of sheet material which is located at least partly above the container conveying line and from which capsule bottom linings are cut and inserted into the containers.

In this station, each bottom lining is cut from the web, fed downwardly and inserted into the respective container. Where provided, in the same station, the bottom lining is sealed to the container.

Next, in a filling station, the containers are filled with a suitably measured quantity of the aromatic substance.

Downstream of the filling station along the feed direction, prior art machines comprise a station for closing the capsules where a cover is applied to each container.

In substantially the same way as with the bottom linings, the closing station is normally provided with a system for feeding a continuous web of film, which is located at least partly above the container conveying line and from which the covers are cut and applied to the mouth at the top of each container.

In this station, each cover is cut from the web, fed downwardly and applied and sealed to the respective container.

Generally speaking, to apply both the covers and, if provided, the bottom linings, the above mentioned operations are performed by actuator means equipped with knives for cutting the covers or the bottom linings, with pickup elements for holding the covers or the bottom linings and, if necessary, with sealers. The actuator means, spaced at the same spacing as the containers being processed, each basically comprise a rod movable between a raised position and a lowered position for applying/positioning the bottom lining or the cover in or on the container. At a position intermediate between the end positions, as mentioned, the bottom lining or the cover is cut from the respective continuous web.

In the specific case of the covers, since the same actuator element has to cut, position and seal the cover, the latter has to be cut to a size much larger than the size of the mouth at the top of the container, which means that much more material is used than is actually necessary to close the container.

Also, since the spacing and relative position of the containers on the line is substantially dictated by constructional requirements, the actuator means for cutting and positioning the covers and, if necessary, the bottom linings are, as already mentioned, spaced at the same spacing as the containers.

This configuration leads to the formation of large amounts of waste offcuts from the webs from which the covers and the bottom linings are cut.

In this context, the main technical purpose of this invention is to propose a packaging machine and method for making capsules which are free of the above mentioned disadvantages.

DISCLOSURE OF THE INVENTION

One aim of this invention is to provide a packaging machine and method for making capsules which allow reducing the amount of material used in particular for the covers.

A further aim of the invention is to provide a packaging machine for making capsules where the amount of waste offcuts resulting from cutting the webs for the covers and/or the bottom linings is reduced.

The technical purpose and aims specified are substantially achieved by a packaging machine for making capsules and by a packaging method for making capsules according to the present disclosure.

BRIEF DESCRIPTION OF THE DRAWINGS

Further features of the invention and its advantages are more apparent in the non-limiting description below, with reference to a preferred but non-exclusive embodiment of a packaging machine for making capsules, as illustrated in the accompanying drawings, in which.

DETAILED DESCRIPTION OF PREFERRED EMBODIMENTS OF THE INVENTION

With reference to the accompanying drawings, the numeral 1 denotes a packaging machine for making capsules 100. The machine 1 is hereinafter described only insofar as necessary for understanding this invention.

Figure 13:
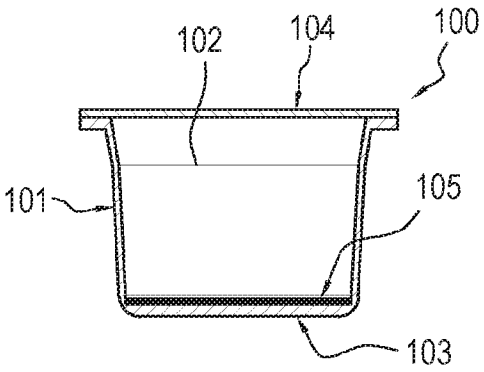
FIG. 13 illustrates a capsule made with a machine according to the invention in a schematic side view partly in cross section.

By way of an example, FIG. 13 shows a capsule 100 basically comprising a container 101, for example cup-shaped, provided with a mouth 102 and a bottom 103 through which is dispensed the beverage produced by effect of the infusion of the water with an aromatic substance present in the container and not illustrated.

The reference capsules 100 are single-use capsules and further comprise a perforatable cover 104 through which water can be fed, and a bottom lining 105, for example a filter element, positioned, in the example illustrated, on the bottom 103 of the container 101.

Hereinafter, the term "disc-shaped element" is used generically to denote the cover 104 and/or the bottom lining 105, since the machine 1 is preferably structured to prepare and apply both the cover 104 and the bottom lining 105 in substantially the same way.

In alternative embodiments, the cover and/or the bottom lining and/or the filter element are not disc-shaped.

The machine 1 comprises movement means by which the containers 101 are directed along a predetermined path P in a feed direction V.

The movement means for moving the containers 101 comprise, for example, a plurality of trays 2 and a system for feeding the trays 2 and schematically represented as a block 3.

Each tray 2 is provided with a plurality of pockets 4, each designed to receive a respective container 101.

In the preferred embodiment illustrated, each tray 2 comprises eight pockets 4 for as many containers 101.

The pockets 4 are located on the tray 2 at fixed, predetermined positions suitably spaced from each other.

For convenience of description, reference is hereinafter made to the "spacing" of the pockets 4 on the tray 2 to also mean the reciprocal position of the pockets 4 themselves.

The machine 1 comprises movement means by which a continuous web W is moved along a respective predetermined path P1 in a feed direction V1. Of the movement means for moving the web W only a transmission roller 5 is, for convenience, illustrated.

The path P and the path P1 are substantially parallel to each other along at least one stretch, as will become clearer as this description continues.

The web W is used to make the aforementioned disc-shaped element 104, 105 and is, for example, of butter muslin if used to make the filter elements 105 or of film if used to make the covers 104.

The machine 1 comprises a cutoff station 6 where the disc-shaped elements 104, 105 are cut from the web W and an associating station 7 where the disc-shaped elements 104, 105 are associated with the containers 101.

The associating station 7 is distinct from the cutoff station 6 and is preferably located downstream thereof along the feed direction V of the containers 101.

With reference to the drawings, the cutoff station 6 is located along the path P1 of the web W to cut the web W.

The station 6 is located above the feed path P of the containers 101, in particular substantially along the stretch where the two paths P, P1 are parallel.

The machine 1 comprises first transfer means by which the disc-shaped elements 104, 105 are transferred from the cutoff station 6 to the associating station 7.

The first transfer means are movable along the predetermined path P, and more specifically, parallel thereto.

Figure 6:
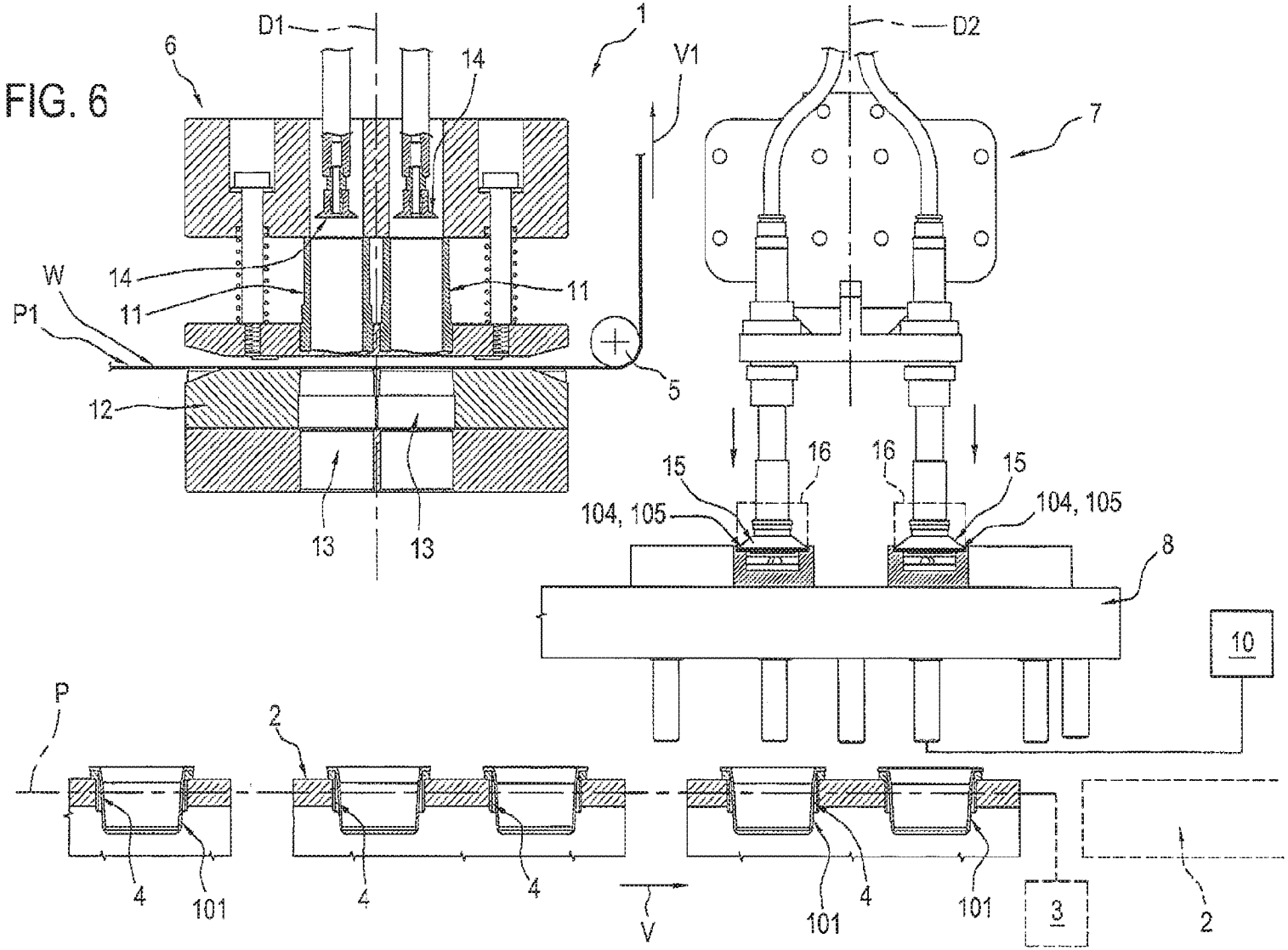
Figure 7:
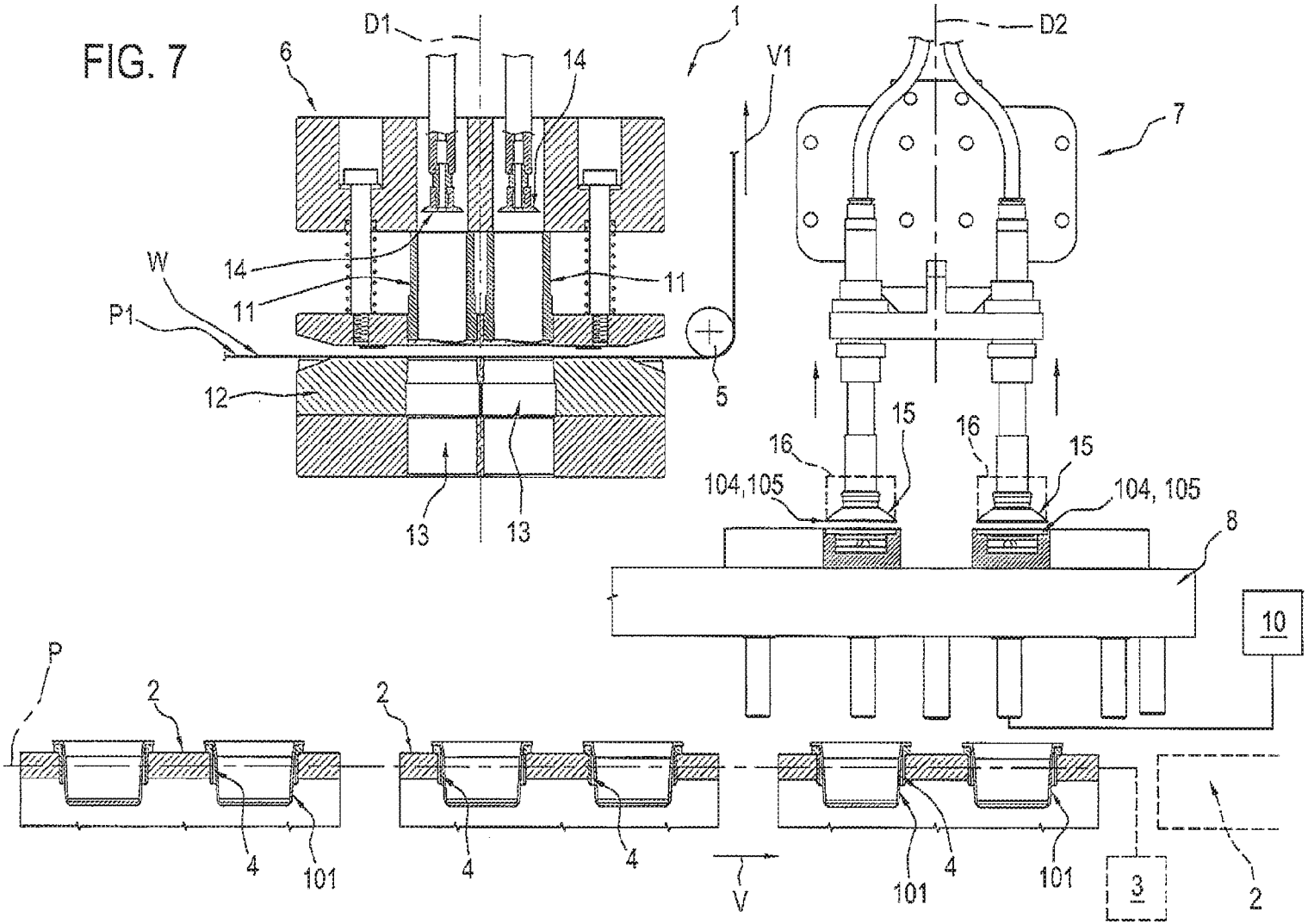
Figure 8:
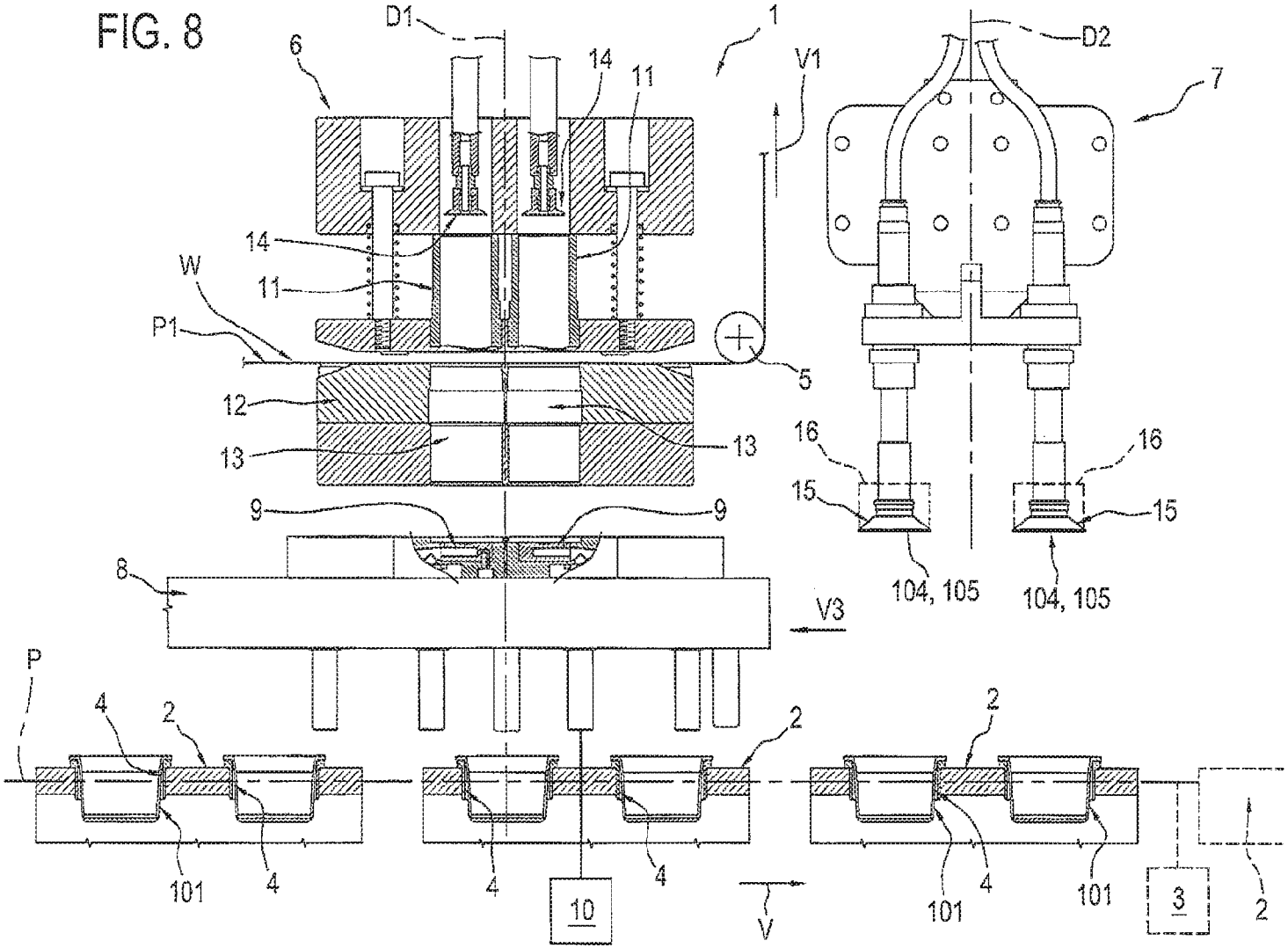

The first transfer means are movable between a first operating position, illustrated in FIGS. 1, 2, 3, 4, 8, 9 at the cutoff station 6, and a second operating position, illustrated in FIGS. 6, 7, at the associating station 7.

Figure 10:
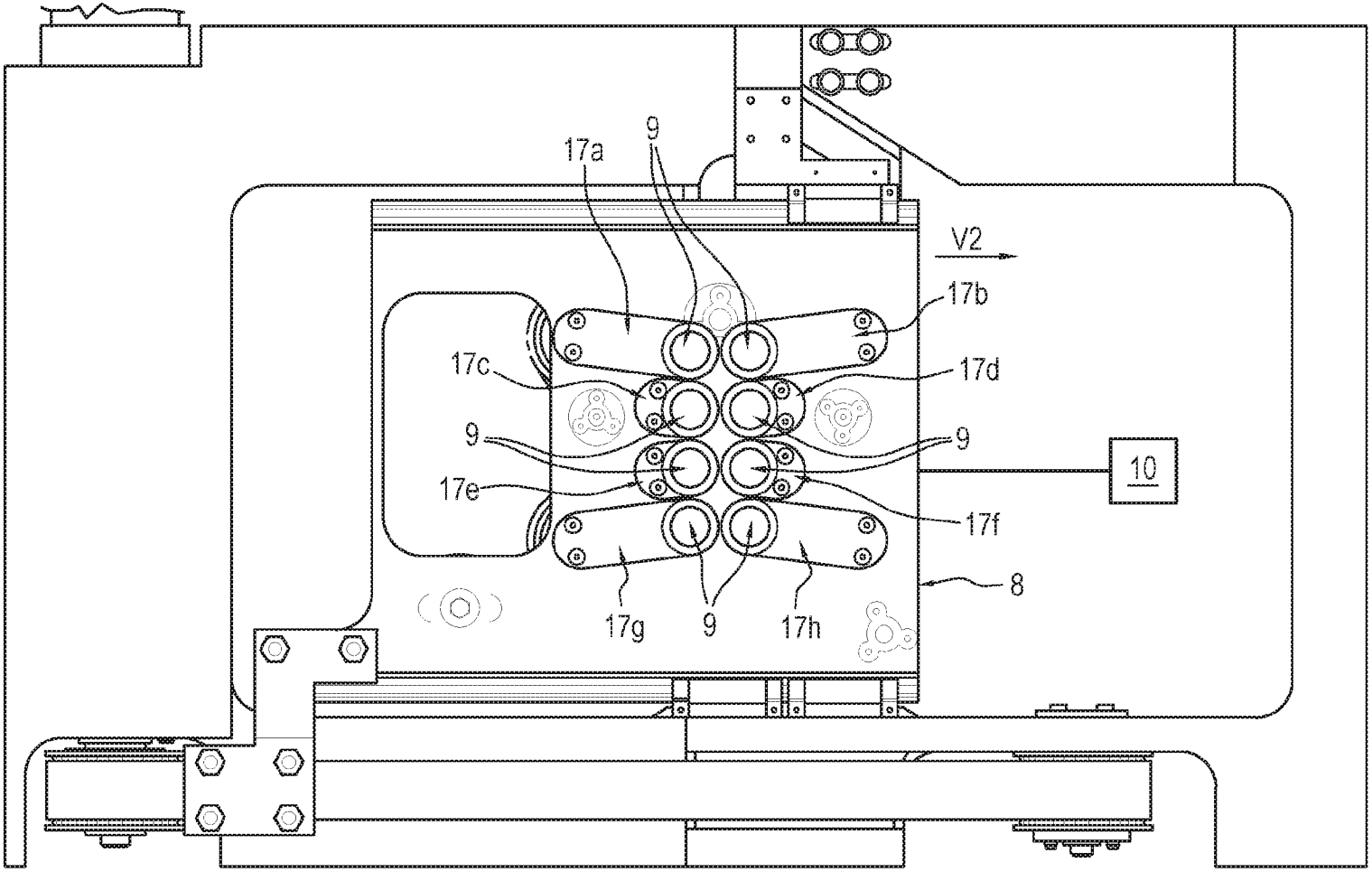
FIG. 10 illustrates a detail of the machine of the preceding figures in the configuration of FIG. 1 in a schematic top plan view with some parts cut away for greater clarity.
Figure 11:
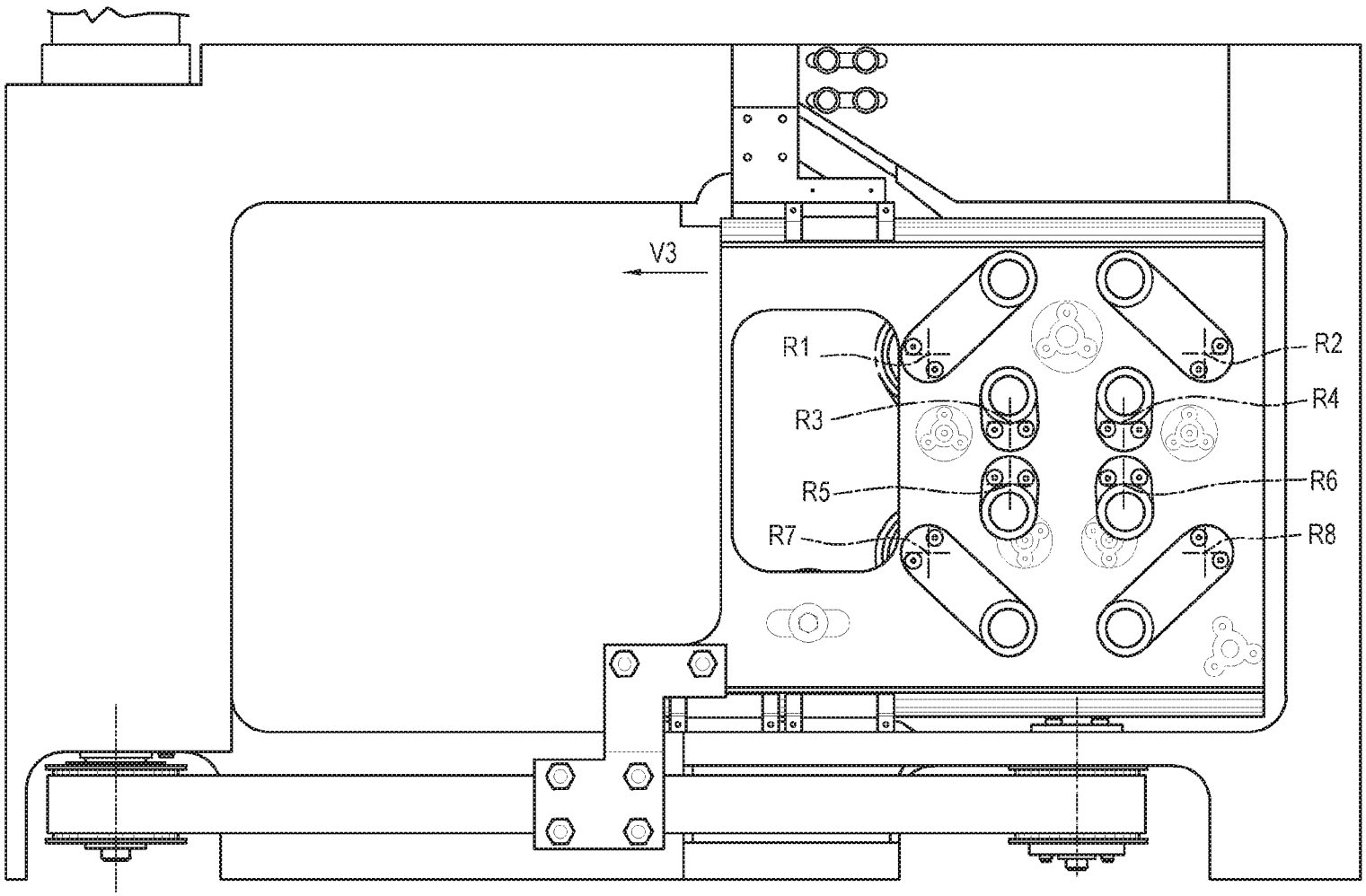
FIG. 11 illustrates the detail of FIG. 10 in the configuration of FIG. 5 in a schematic top plan view with some parts cut away for greater clarity.

More specifically, also with reference to FIGS. 10 and 11, the first transfer means comprise a carriage 8 between the cutoff station 6 and the associating station 7.

The carriage 8 is preferably movable parallel to the path P and performs a forward stroke in a direction V2 from the cutoff station 6 to the associating station 7 and a return stroke in a direction V3 from the associating station 7 to the cutoff station 6.

The first transfer means comprise a plurality of pockets 9, each for a disc-shaped element 104, 105, provided on the carriage 8.

The pockets 9 are movable as one with the carriage between a first operating position for receiving the disc-shaped elements 104, 105 at the cutoff station 6 and a second operating position for releasing the disc-shaped elements 104, 105 at the associating station 7.

The first transfer means comprise a system for driving the carriage 8, schematically represented as a block 10, for feeding the carriage 8 from the cutoff station 6 to the associating station 7 and vice versa.

In practice, the disc-shaped elements 104, 105 are cut from the web W at the cutoff station 6 and then transferred by the first transfer means to the corresponding associating station 7 where they are applied to the containers 101.

More specifically, the disc-shaped elements 104, 105 are placed in the pockets 9 and fed by the carriage 8 to the associating station 7.

Looking in more detail at the cutoff station 6, it may be observed that this station 6 comprises means for cutting the disc-shaped elements 104, 105 and second means for transferring the disc-shaped elements 104, 105 from the cutoff station 6 to the first transfer means, and more specifically, to the pockets 9.

In practice, the second means for transferring the disc-shaped elements 104, 105 transfer the disc-shaped elements 104, 105 from the path P1 to the path P.

The cutting means comprise a plurality of cutters 11 each for cutting a corresponding disc-shaped element 104, 105.

Figure 1:
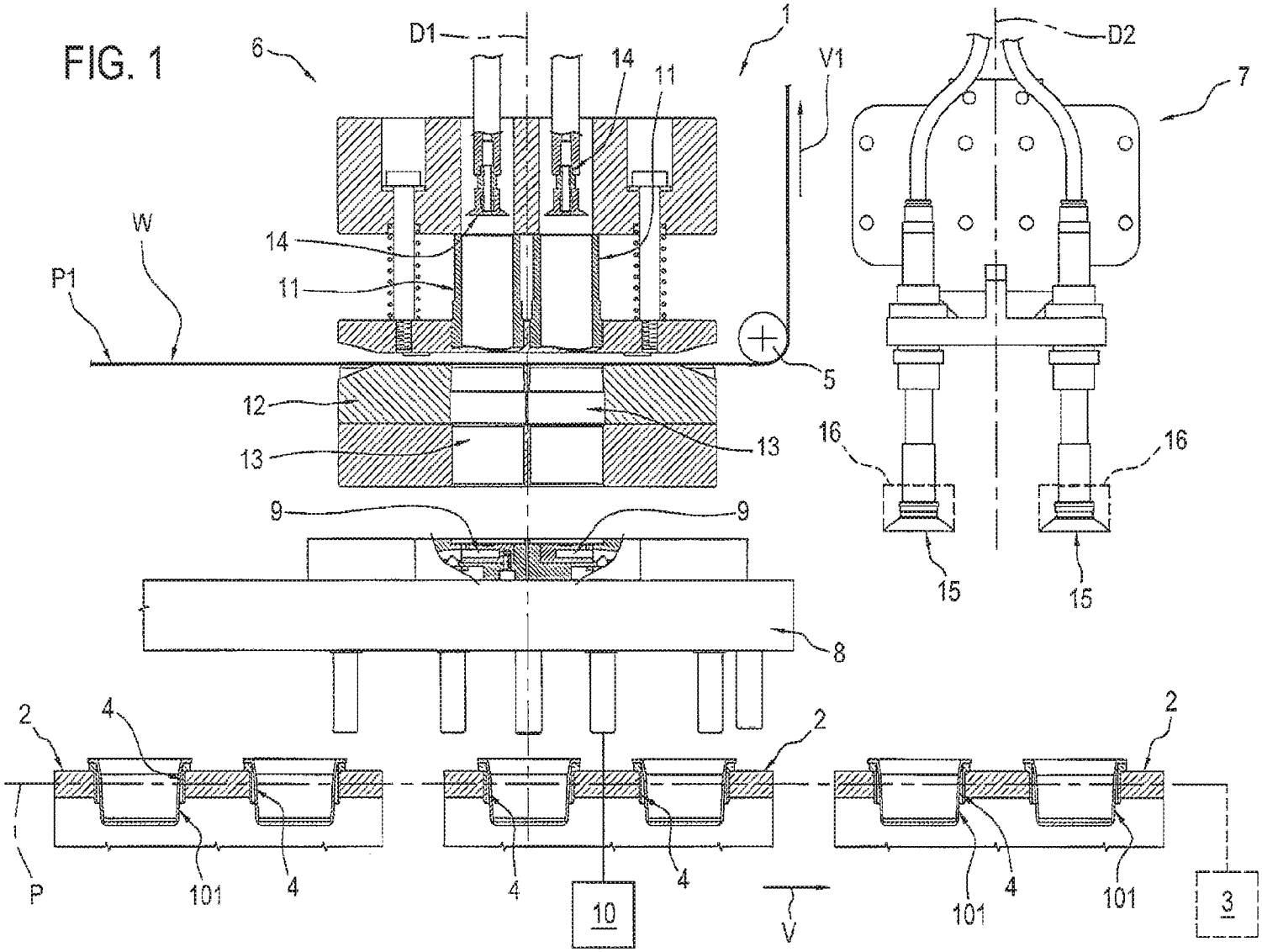
FIGS. 1 to 9 illustrate a packaging machine for making capsules according to this invention in schematic front views with some parts cut away for greater clarity and in a sequence of operating configurations.
Figure 2:
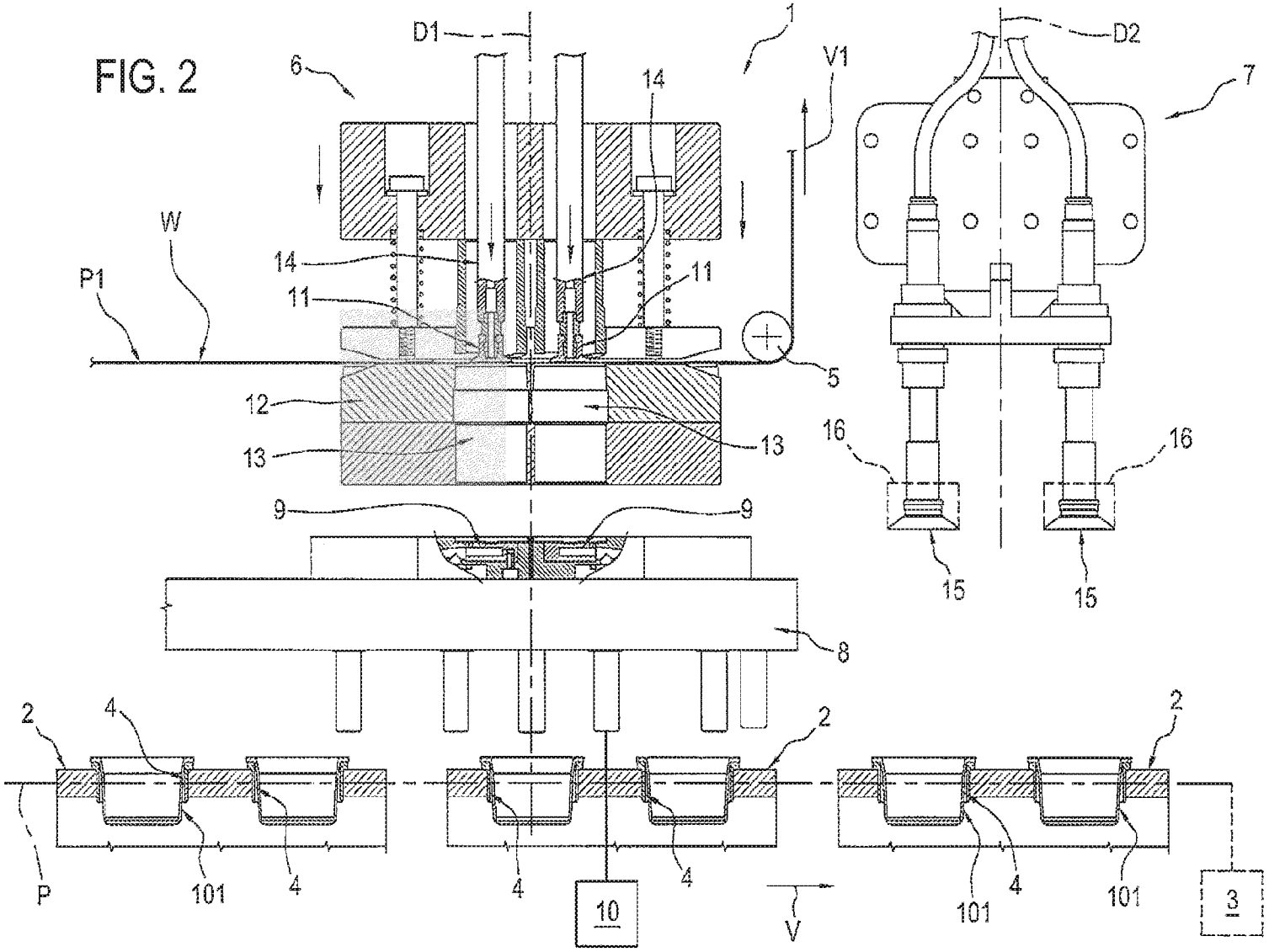
Figure 3:
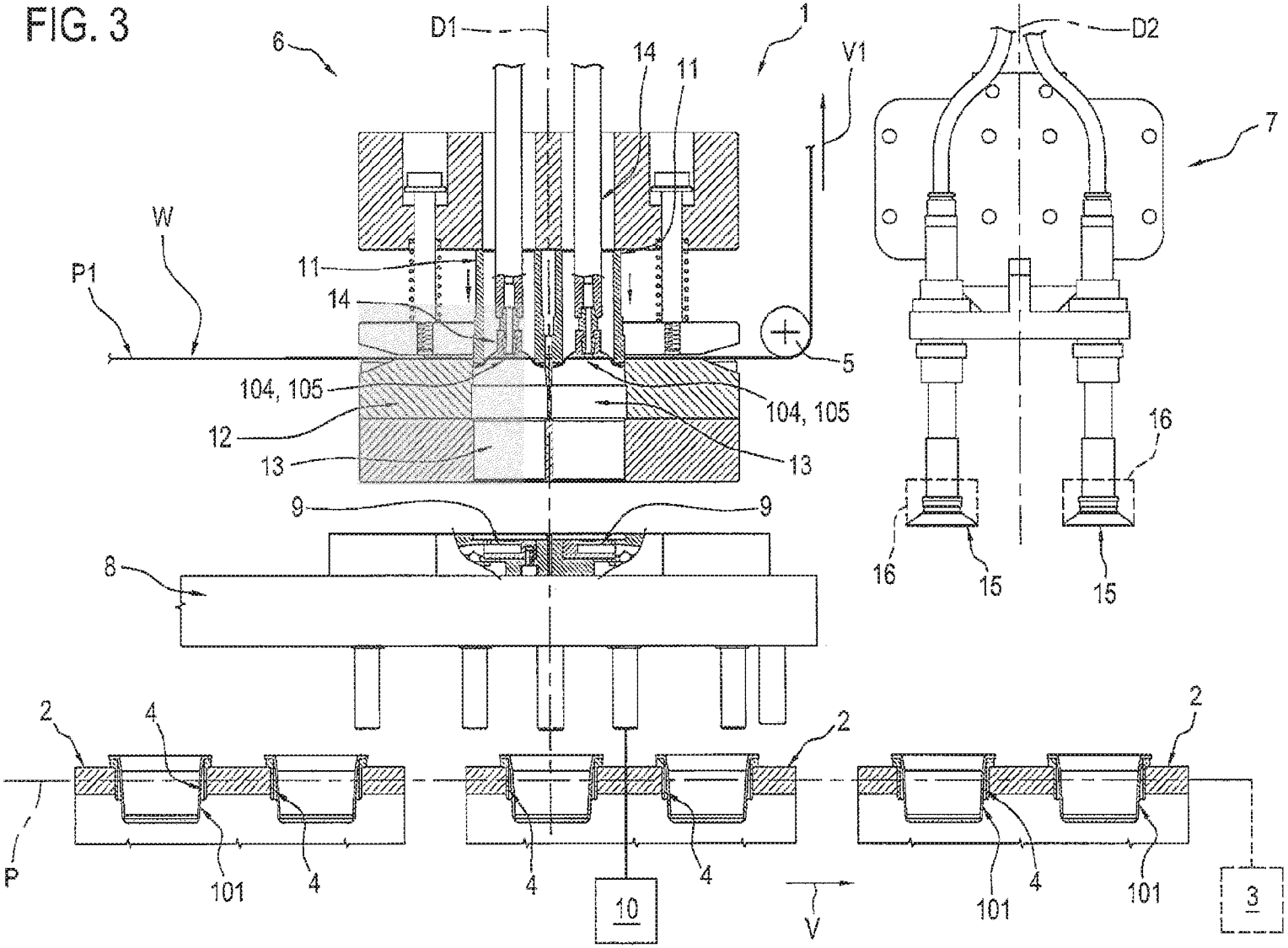

Each cutter 11 is movable along a cutting direction D1, preferably vertical and at right angles to the paths P and P1, between a raised, rest position, illustrated in FIG. 1, and a lowered position for cutting the disc-shaped elements 104, 105, illustrated in FIG. 3.

More specifically, the cutters 11 intercept the web W along the path P1 when they are at the lowered position.

The cutting means comprise a die block 12 for the web W which acts in conjunction with the cutters 11 to cut the disc-shaped elements 104, 105 and which defines a cutting system known also as "punch and die".

When cutting the disc-shaped elements 104, 105, the cutting blade is thus supported by the die block allowing better and cleaner cuts to be made than in prior art solutions.

The die block 12 has a plurality of through holes 13 for the receiving and transit of the disc-shaped elements 104, 105.

The second transfer means comprise a plurality of pickup and feed elements 14, for example operating by suction, not further described, each for transferring a corresponding disc-shaped element 104, 105 to the aforementioned pockets 9 provided on the carriage 8.

Figure 4:
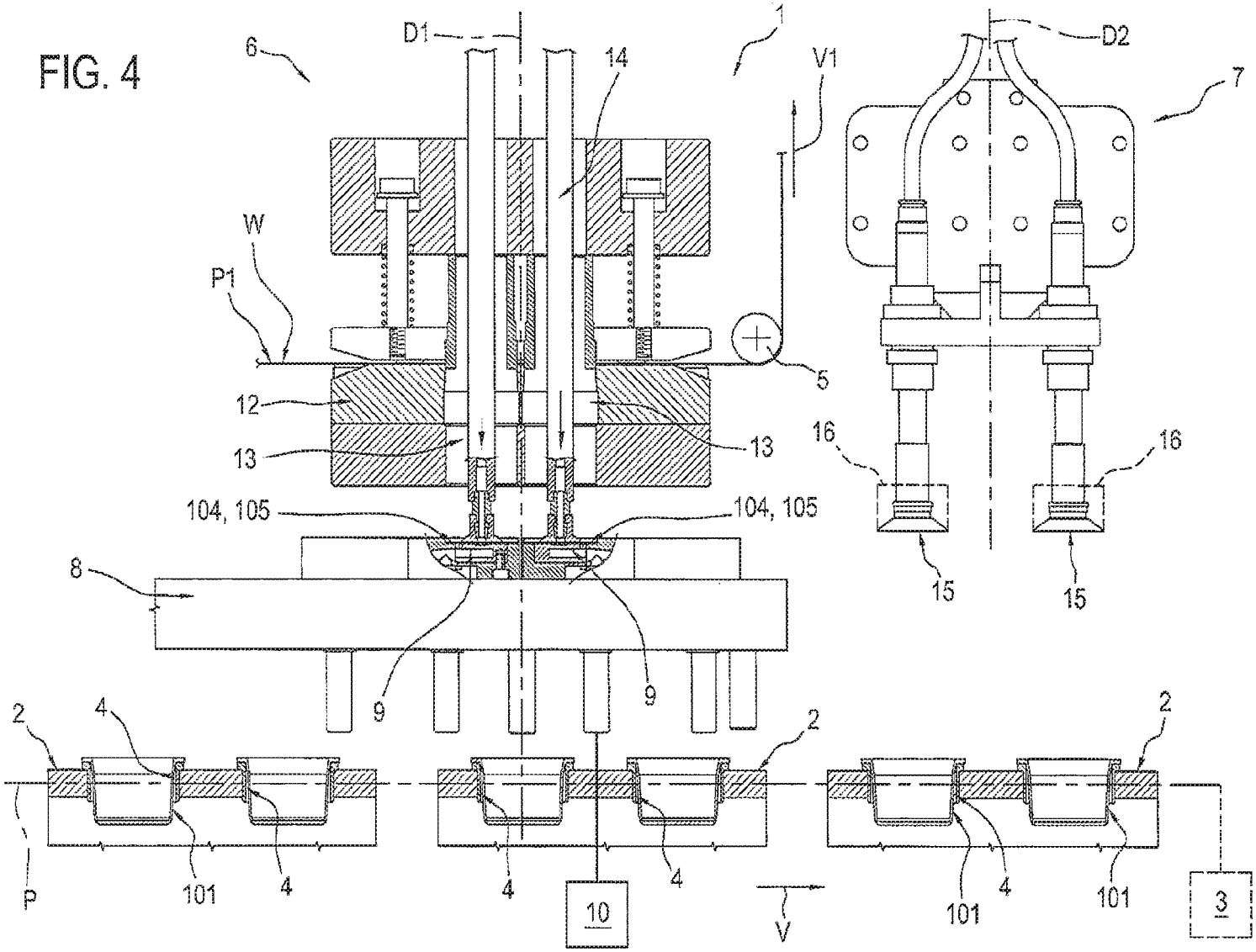
Figure 5:
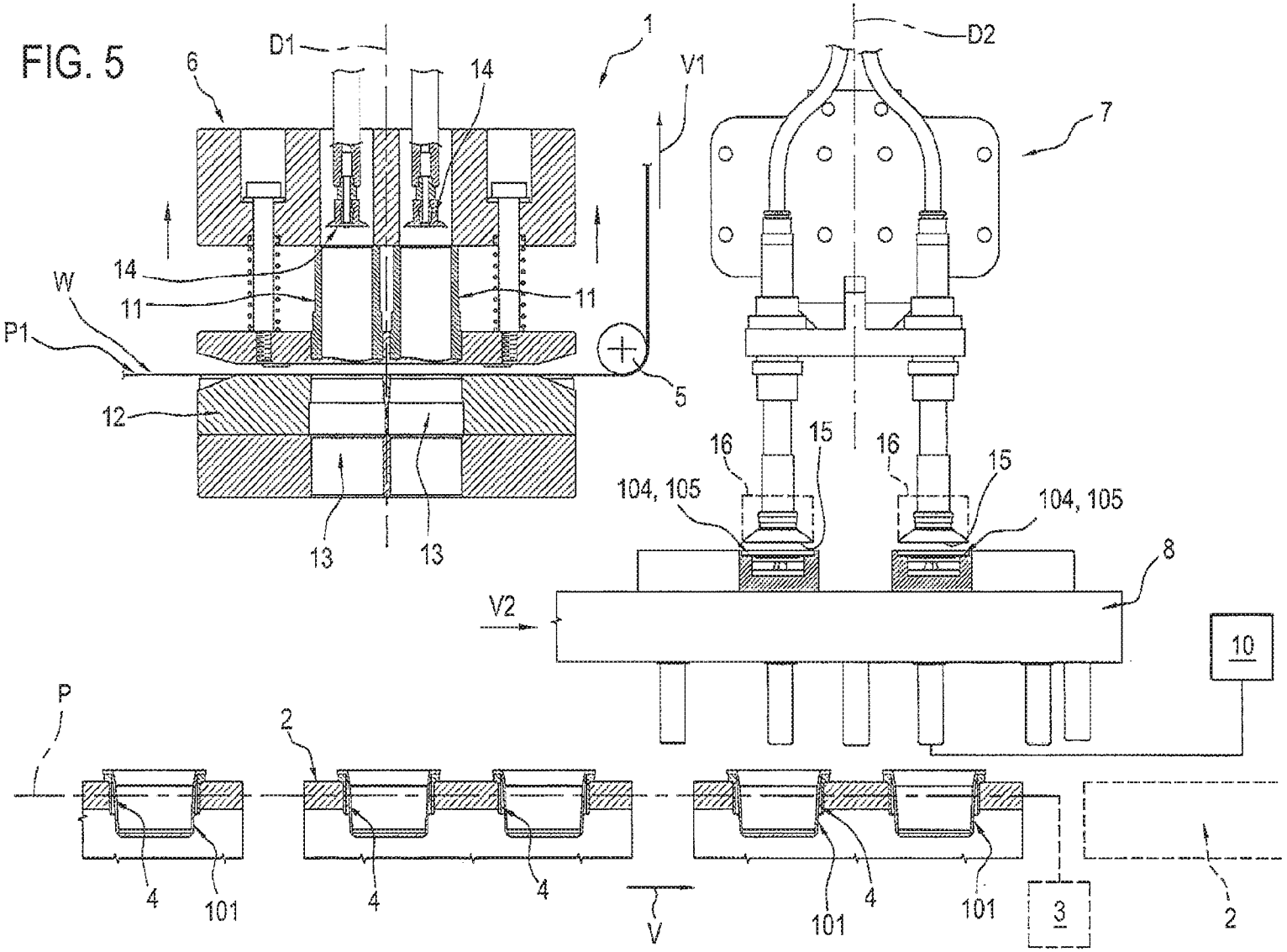

Each element 14 is movable, preferably along the cutting direction D1, between a raised, rest position, illustrated in FIG. 1, and a lowered position for transferring the disc-shaped element 104, 105, illustrated in FIG. 4, to the respective pocket 9.

Preferably, the aforementioned cutters 11 are tubular and each pickup element 14 is located inside a corresponding cutter 11.

It may be observed that the pickup elements 14 are movable through the holes 13 in the die block 12.

At the lowered transfer position, the pickup elements 14 are located below the tubular cutters 11 at the lowered position and below the die block 12.

The first transfer means, in particular the carriage 8 with the pockets 9, are located below the predetermined path P1 and below the web W.

The first transfer means, in particular the carriage 8 with the pockets 9, are located above the predetermined path P and above the trays 2.

At the first operating position, the carriage 8 is interposed between the cutters 11 and the trays 2 in the cutting direction D1.

The associating station 7 comprises respective elements 15 for picking up and feeding the disc-shaped elements 104, 105, each for transferring a corresponding disc-shaped element 104, 105 from the pockets 9 of the carriage 8 to a corresponding container 101 fed by the trays 2.

The transfer of the disc-shaped element 104, 105 from the first transfer means to the containers 101 occurs preferably when the containers 101 themselves are stationary at the station 7.

With reference to the accompanying drawings, the pickup and retaining elements 15 are located above the path P and, in particular, above the trays 2.

Figure 9:
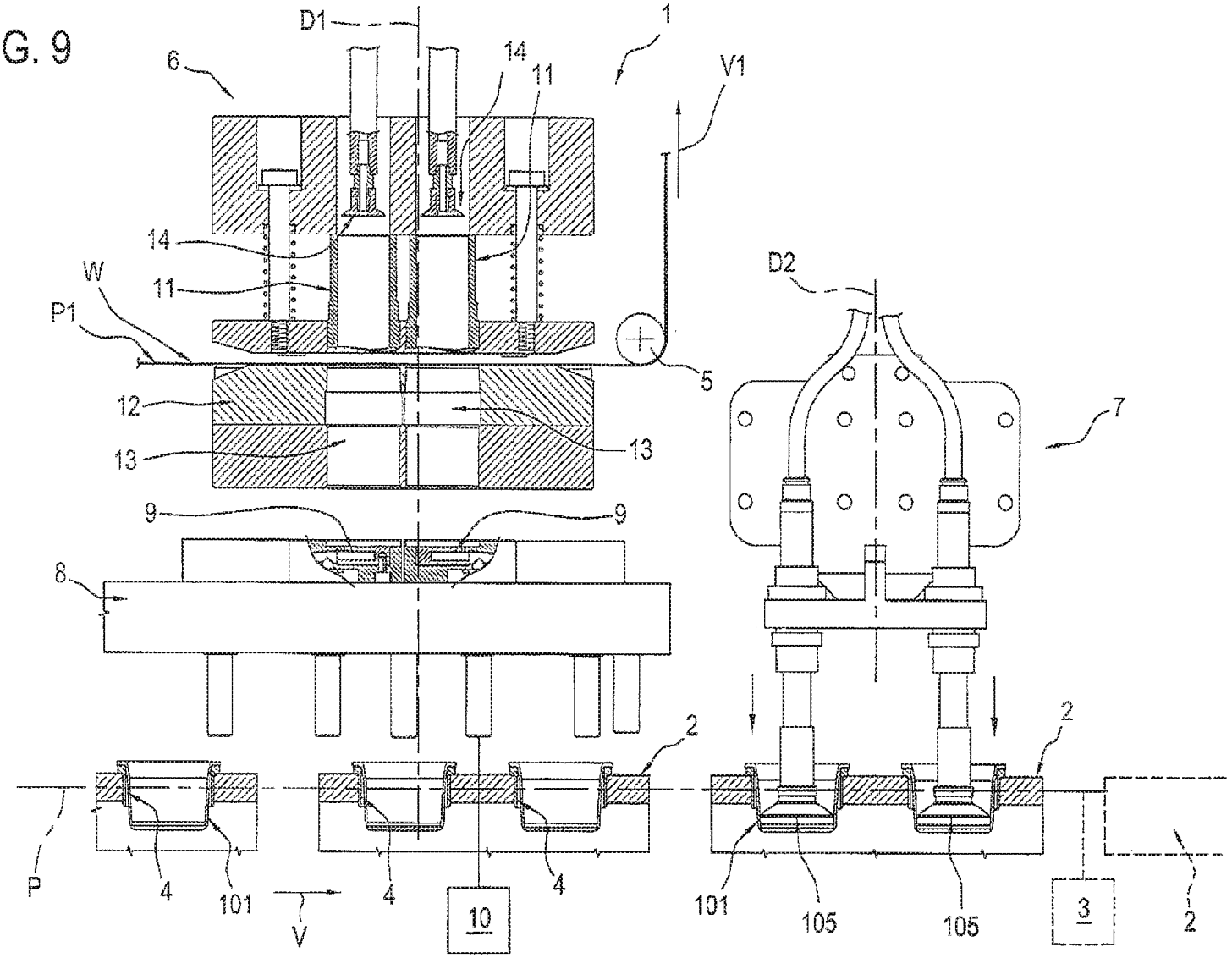

Each second pickup and retaining element 15 is movable along an application direction D2, preferably parallel to the cutting direction D1, between a raised, rest position, illustrated by way of example in FIGS. 1 to 4, and a lowered position for applying the corresponding disc-shaped element 104, 105 to the respective container 101, illustrated in FIG. 9, which in particular shows by way of an example the application of the bottom lining 105 in the container 101.

Each element 15 can be stopped at an intermediate position, illustrated in FIG. 6, between the raised and the lowered position, for picking up the disc-shaped element 104, 105 from the respective pockets 9.

In one embodiment of the machine 1, the station 6 and the station 7 form part of an apparatus for applying the cover 105 to the container 101.

In that case, the station 7 for associating the cover 105 comprises a sealer 16, illustrated by way of example by a dashed line in FIG. 1, for each pickup element 15, to attach the cover 105 to the container 101.

The machine 1 comprises a sealing station, not illustrated, located downstream of the associating station 7 in the feed direction V, for completely and definitively sealing the cover 105 to the container 101.

In practice, the sealer 16 temporarily attaches the cover 105 to the container 101 so it remains in position until transfer to the sealing station.

Associating the cover 105 with the container 101 in a station 7 distinct from the cutoff station, by means of dedicated pickup and positioning elements 15 not connected to the cutters allows cutting the cover 105 in a size substantially the same as an outer edge of the mouth 102 of the capsule 100, allowing considerable savings in material compared to prior art solutions.

Advantageously, the use of a "punch and die" cutting system allows making clean, precise cuts.

Sealing the covers at a station distinct from the associating station improves the quality of the seal compared to prior art solutions.

In the preferred embodiment illustrated in the accompanying drawings, the cutters 11 are positioned relative to each other in a fixed, predetermined first configuration.

More specifically, the cutters 11 are positioned relative to each other according to a spacing which is different from the spacing of the pockets 4 in the trays 2.

Advantageously, the cutters 11 are spaced more closely together than the pockets 4 are.

Since the elements 14 for picking up the disc-shaped elements 104, 105 in the station 6 are, as mentioned above, preferably slidable inside the cutters 11, they are positioned relative to each other according to the spacing thereof.

The pickup elements 15 in the station 7 are positioned relative to each other according to a fixed, predetermined second configuration.

The elements 15 are positioned relative to each other in such a way that each is aligned with a corresponding pocket 4 along the application direction D2, considering in particular a tray 2 which is stationary at the station 7.

The means for transferring the disc-shaped elements 104, 105 from the station 6 to the station 7 comprise means for positioning the disc-shaped elements 104, 105 movable between a first operating position for receiving the disc-shaped elements 104, 105 in the station 6 and a second operating position for releasing the disc-shaped elements 104, 105 in the station 7.

The positioning means, mounted on the carriage 8, comprise the aforementioned pockets 9 which, in the cutoff station 6, are positioned according to the first configuration, that is according to the position of the cutters 11, and, in the associating station 7, according to the second configuration, that is, according to the position of the pickup elements 15.

In other words, the pockets 9 are movable between the first configuration, illustrated in FIG. 10, where each is aligned with a corresponding cutter 11 along the cutting direction D1 when the carriage 8 is under the cutoff station 6, and the second configuration, illustrated in FIG. 11, where each is aligned with a corresponding pickup and feed element 15 along the application direction D2 when the carriage 8 is at the associating station 7.

In the embodiment illustrated in particular in FIGS. 10, 11, the positioning means comprise a plurality of movable elements 17*a*, 17*b*, 17*c*, 17*d*, 17*e*, 17*f*, 17*g*, 17*h* associated with the carriage 8, each bearing a respective pocket 9, The pockets 9 are movable between the first configuration and the second configuration through the agency of the movable elements 17.

More specifically, the elements 17 are rotatably connected to the carriage 8 and are rotatable about respective axes R1, R2, R3, R4, R5, R6, R7, R8 which are parallel to each other and preferably parallel to the directions D1 and D2.

The aforementioned system 10 for driving the carriage 8 is configured to also drive the elements 17 in rotation about the respective axes R1-R8.

Figure 12:
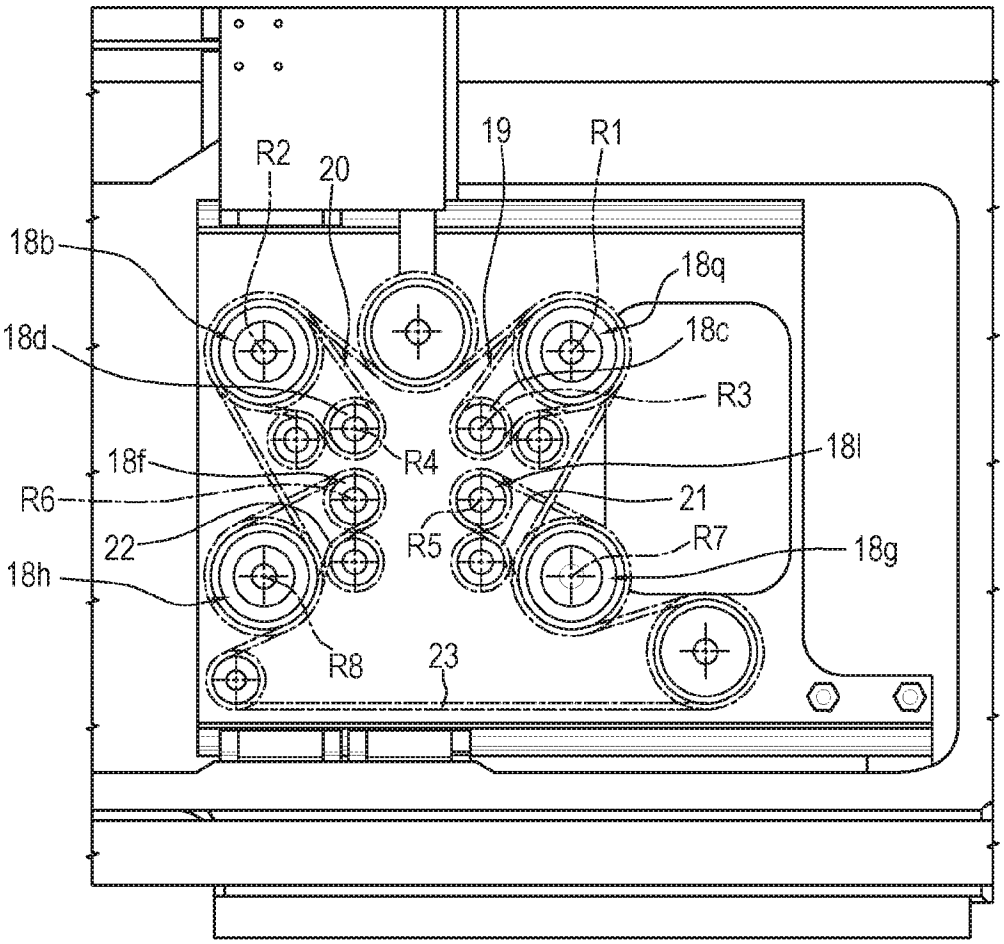
FIG. 12 illustrates the detail of FIGS. 10 and 11 in a schematic bottom plan view with some parts cut away for greater clarity.

In an embodiment illustrated schematically in FIG. 12, the system 10 for driving the elements 17 comprises a plurality of pulleys 18.

More specifically, each element 17*a*, 17*b*, 17*c*, 17*d*, 17*e*, 17*f*, 17*g*, 17*h* is mounted coaxially with a respective pulley 18*a*, 18*b*, 18*c*, 18*d*, 18*e*, 18*f*, 18*g*, 18*h*, which are preferably located on the side of the carriage 8 opposite to the elements 17.

In the embodiment illustrated, the pulleys 18*a*, 18*c* are connected to a respective endless belt 19 looped around them.

The pulleys 18*b*, 18*d* are connected to a respective endless belt 20 looped around them.

The pulleys 18*e*, 18*g* are connected to a respective endless belt 21 looped around them.

The pulleys 18*f*, 18*h* are connected to a respective endless belt 22 looped around them.

Each belt 19, 20, 21, 22 is kept suitably tensioned by a respective tensioning pulley which is not labelled and which also forms part of the drive system 10.

A drive belt 23 drives the pulleys 18*a*, 18*b*, 18*g* and 18*h*, which are thus driven pulleys. The drive system 10 comprises a drive pulley 24 for driving the belt 23.

The system 10 drives the pockets 9 between the first and the second configuration, in particular from the first configuration to the second in the forward stroke and from the second configuration to the first in the return stroke.

More specifically, the elements 17*a*, 17*c*, 17*f*, 17*h* perform an anticlockwise rotation in the forward stroke and vice versa in the return stroke, while the elements 17*b*, 17*d*, 17*e*, 17*g* perform a clockwise rotation in the forward stroke and vice versa in the return stroke.

The disc-shaped elements 104, 105 are further spaced from each other compared to the first starting configuration at the cutoff station 6 at least along two orthogonal directions of which one is preferably parallel to the feed direction of the containers 101.

In use, the packaging method for making the capsules 100 comprises a step of feeding the containers 101 along the path Pin the feed direction V.

The method comprises a step of cutting the disc-shaped elements 104, 105 from the continuous web W which is movable along the path P1 in the cutoff station 6

The web W is stopped in the cutoff station 6 during the action of the cutters 11.

The disc-shaped elements 104, 105 are cut by the cutters 11 and fed, preferably by the elements 14, into the pockets 9 on the carriage 8 positioned in the configuration where they are close to each other.

More specifically, the disc-shaped elements 104, 105 are fed to the pockets 9 by lowering the elements 14.

The carriage 8 moves into the associating station 7, distinct from the cutoff station 6, and preferably during the forward stroke, the pockets 9, and hence the disc-shaped elements 104, 105, are brought to the second configuration where they are far apart, that is, positioned at the same spacing as the pockets 4 on the trays 2 and at the same spacing as the pickup and feed elements 15, preferably by a rotation of the supporting elements 17 of the pockets 9.

At the station 7, the disc-shaped elements 104, 105 are withdrawn from the pockets 9 by the pickup elements 15.

After transfer has taken place, the pickup elements 15 are lowered to the disc-shaped elements 104, 105 on the carriage 8 and each grips a corresponding disc-shaped element 104, 105.

The pickup elements 15 lift the disc-shaped elements 104, 105 out of the carriage 8 which returns to the cutoff station 6.

Once the carriage 8 has moved, as illustrated in FIG. 9, the pickup elements 15 move down as far as the containers 101.

In the case illustrated, where the bottom lining or filter element 104 is applied, the elements 15 are fed substantially as far as the bottom 103 of the container 101 in order to position the disc-shaped element 105.

In the case where the cover 104 is applied once the container 101 is filled with the aromatic substance, for example coffee, the disc-shaped element 104 is fed as far as the mouth 102.

As already mentioned, at the station 7, the cover 104 is attached to the container 101 by means of the sealer 16.

Moving the pockets which receive the bottom linings from a position where they are close together to a position where they are further apart allows considerably reducing the amount of waste offcuts during cutting of the web W.

Since the disc-shaped elements, both in the case of the bottom linings and the covers, can be cut off as closely to each other as possible, irrespective of the spacing of the containers 101 which the disc-shaped elements will be applied to, it is possible to optimize the use of the material of the web W.

The invention claimed is:

1. A packaging machine for making capsules, each comprising a container having an inlet opening and a bottom and a substantially disc-shaped element combined with the container, the machine comprising:

a first movement device configured to direct the containers along a first predetermined path in a feed direction;

a second movement device configured to move a continuous web for defining the disc-shaped elements along a second predetermined path;

a cutoff station where the disc-shaped elements are cut from the continuous web, the cutoff station being positioned along the second predetermined path and comprising at least one cutter configured for cutting the disc-shaped elements;

an associating station where the disc-shaped elements are combined with the containers and which is positioned along the first predetermined path, the associating station being distinct from the cutoff station;

a first transfer device by which the disc-shaped elements are transferred from the cutoff station to the associating station and which operate between the cutoff station and the associating station, the machine wherein the cutoff station comprises a second transfer device by which the disc-shaped elements are transferred from the at least one cutter to the first transfer device;

wherein the associating station comprises a plurality of associating pickup and feed elements, each including a feed surface configured for transferring a corresponding disc-shaped element from the first transfer device to a corresponding container in the first movement device.

2. The machine according to claim 1, wherein the first transfer device includes a positioning device including at least one positioning surface configured for positioning the disc-shaped elements movable between a first operating position for receiving the disc-shaped elements in the cutoff station and a second operating position for releasing the disc-shaped elements in the associating station.

3. The machine according to claim 2, wherein the at least one positioning surface includes a plurality of pockets for the disc-shaped elements, the pockets being positioned in the first operating position at the cutoff station and in the second operating position at the associating station.

4. The machine according to claim 1, wherein the associating station is positioned along the first predetermined path downstream of the cutoff station in the feed direction, the first transfer device operating along the first predetermined path.

5. The machine according to claim 1, wherein the at least one cutter is positioned above the first transfer device, the first transfer device being interposed between the at least one cutter and the first movement device considering a cutting direction transversal to the first predetermined path.

6. The machine according to claim 1, wherein the at least one cutter includes a plurality of cutters each for cutting a corresponding disc-shaped element and movable along a cutting direction between a raised, rest position and a lowered position for cutting the disc-shaped elements, the cutters intercepting the web along the second predetermined path when they are at the lowered position.

7. The machine according to claim 1, wherein the second transfer device comprises a plurality of cutoff pickup and feed elements, each including a feed surface configured for transferring a corresponding disc-shaped element to the first transfer device, each cutoff pickup and feed element being inserted in a corresponding one of the at least one cutter and being movable between a raised, rest position and a lowered position for transferring the disc-shaped element to the first transfer device.

8. The machine according to claim 7, wherein the cutoff pickup and feed elements at the lowered, transfer position are positioned below the at least one cutter at the lowered position, the first transfer device being located below the second predetermined path.

9. The machine according to claim 1, wherein each associating pickup and feed element is movable between a raised, rest position and a lowered position combining the corresponding disc-shaped element with the respective container.

10. The machine according to claim 1, wherein the first transfer device operates along the first predetermined path and is movable between a first operating position at the cutoff station and a second operating position at the associating station.

11. The machine according to claim 1, wherein the at least one cutter comprises a plurality of cutters each for cutting a corresponding disc-shaped element, the cutters being positioned relative to each other in a first predetermined configuration;

the associating station comprising a plurality of associating pickup and feed elements, each including a feed surface configured to feed the disc-shaped elements to the containers in an application direction, the associating pickup and feed elements being positioned relative to each other in a second predetermined configuration;

the first transfer device comprising a positioning device including at least one positioning surface configured for positioning the disc-shaped elements and which are movable between a first operating position for receiving the disc-shaped elements and a second operating position for releasing the disc-shaped elements, the at least one positioning surface comprising a plurality of pockets for the disc-shaped elements, the pockets being positioned in the first configuration at the cutoff station and in the second configuration at the associating station.

12. The machine according to claim 11, wherein the first transfer device comprises a carriage movable along the first predetermined path between the cutoff station and the associating station, the first transfer device comprising a plurality of movable elements operatively connected with the carriage, each pocket for a corresponding disc-shaped element being provided on a respective movable element, the pockets for the disc-shaped elements being movable between the first configuration and the second configuration through the agency of the movable elements.

13. The machine according to claim 12, wherein the movable elements are rotatable relative to the carriage, the pockets for the disc-shaped elements being movable between the first configuration and the second configuration by rotation of the respective movable element.

14. The machine according to claim 12, wherein the first transfer device comprises a system for driving the carriage and the movable elements for feeding the carriage between the cutoff station and the associating station and for moving the pockets for the disc-shaped elements between the first configuration and the second.

15. The machine according to claim 1, wherein the first movement device comprises a tray for supporting the containers, the tray comprising a plurality of pockets for the containers, the pockets for the containers being located at a predetermined position, each pocket for the disc-shaped elements in the second configuration being aligned with a corresponding pocket for the containers according to the application direction in the associating station.

16. The machine according to claim 1, and further comprising an apparatus for applying a cover to the container, the apparatus for applying a cover to the container comprising the cutoff station and the associating station, the cover being defined by the disc-shaped element.

17. The machine according to claim 16, wherein the associating station comprises a sealer for applying the cover to the container in such a way as to attach the cover to the container;

and further comprising a sealing station located downstream of the associating station according to the feed direction for sealing the cover to the container.

18. The machine according to claim 1, and further comprising an apparatus for applying a bottom lining to the container, the apparatus for applying a bottom lining to the container comprising a second cutoff station and a second associating station, the bottom lining being defined by the disc-shaped element.

19. A packaging machine for making capsules, each comprising a container having an inlet opening and a bottom and a substantially disc-shaped element combined with the container, the machine comprising:

a first movement device configured to direct the containers along a first predetermined path in a feed direction;

a second movement device configured to move a continuous web for defining the disc-shaped elements along a second predetermined path;

a cutoff station where the disc-shaped elements are cut from the continuous web, the cutoff station being positioned along the second predetermined path and comprising at least one cutter configured for cutting the disc-shaped elements;

an associating station where the disc-shaped elements are combined with the containers and which is positioned along the first predetermined path, the associating station being distinct from the cutoff station;

a first transfer device by which the disc-shaped elements are transferred from the cutoff station to the associating station and which operate between the cutoff station and the associating station, the machine wherein the cutoff station comprises a second transfer device by which the disc-shaped elements are transferred from the at least one cutter to the first transfer device;

wherein the second transfer device comprises a plurality of cutoff pickup and feed elements, each including a feed surface configured for transferring a corresponding disc-shaped element to the first transfer device, each cutoff pickup and feed element being inserted in a corresponding one of the at least one cutter and being movable between a raised, rest position and a lowered position for transferring the disc-shaped element to the first transfer device.

20. A packaging machine for making capsules, each comprising a container having an inlet opening and a bottom and a substantially disc-shaped element combined with the container, the machine comprising:

a first movement device configured to direct the containers along a first predetermined path in a feed direction;

a second movement device configured to move a continuous web for defining the disc-shaped elements along a second predetermined path;

a cutoff station where the disc-shaped elements are cut from the continuous web, the cutoff station being positioned along the second predetermined path and comprising at least one cutter configured for cutting the disc-shaped elements;

an associating station where the disc-shaped elements are combined with the containers and which is positioned along the first predetermined path, the associating station being distinct from the cutoff station;

a first transfer device by which the disc-shaped elements are transferred from the cutoff station to the associating station and which operate between the cutoff station and the associating station, the machine wherein the cutoff station comprises a second transfer device by which the disc-shaped elements are transferred from the at least one cutter to the first transfer device;

wherein the at least one cutter comprises a plurality of cutters each for cutting a corresponding disc-shaped element, the cutters being positioned relative to each other in a first predetermined configuration;

the associating station comprising a plurality of associating pickup and feed elements, each including a feed surface configured to feed the disc-shaped elements to the containers in an application direction, the associating pickup and feed elements being positioned relative to each other in a second predetermined configuration;

the first transfer device comprising a positioning device including at least one positioning surface configured for positioning the disc-shaped elements and which are movable between a first operating position for receiving the disc-shaped elements and a second operating position for releasing the disc-shaped elements, the at least one positioning surface comprising a plurality of pockets for the disc-shaped elements, the pockets being positioned in the first configuration at the cutoff station and in the second configuration at the associating station.

* * * * *